US006780088B1

(12) United States Patent
Nishihara

(10) Patent No.: US 6,780,088 B1
(45) Date of Patent: Aug. 24, 2004

(54) CHEMICAL MECHANICAL POLISHING APPARATUS AND A METHOD OF CHEMICAL MECHANICAL POLISHING USING THE SAME

(75) Inventor: Jun Nishihara, Kanagawa (JP)

(73) Assignee: Sony Corporation, Tokyo (JP)

( * ) Notice: Subject to any disclaimer, the term of this patent is extended or adjusted under 35 U.S.C. 154(b) by 225 days.

(21) Appl. No.: 09/689,987

(22) Filed: Oct. 12, 2000

(30) Foreign Application Priority Data

Oct. 14, 1999 (JP) ..... P11-292329

(51) Int. Cl.[7] ..... B24B 1/00

(52) U.S. Cl. ..... 451/36; 451/41; 451/56; 451/59; 451/72

(58) Field of Search ..... 451/21, 36, 63, 451/41, 283, 287, 56, 72, 443, 59, 444, 910

(56) References Cited

U.S. PATENT DOCUMENTS 5,653,622 A * 8/1997 Drill et al.
5,683,289 A * 11/1997 Hempel, Jr. ..... 451/56
5,957,750 A * 9/1999 Brunelli
6,030,487 A * 2/2000 Fisher, Jr. et al. ..... 156/345.14
6,050,884 A * 4/2000 Togawa et al. ..... 451/67
6,110,011 A * 8/2000 Somekh et al. ..... 451/28
6,120,349 A * 9/2000 Nyui et al.
6,361,413 B1 * 3/2002 Skrovan ..... 451/56
6,575,820 B2 * 6/2003 Liu et al. ..... 451/443
6,609,962 B1 * 8/2003 Nabeya et al. ..... 451/443
2002/0173254 A1 * 11/2002 Liu et al. ..... 451/287
2003/0022606 A1 * 1/2003 Janzen ..... 451/72
2003/0064595 A1 * 4/2003 Wang ..... 438/692
2003/0073391 A1 * 4/2003 Janzen ..... 451/56
2003/0134580 A1 * 7/2003 Sakurai et al. ..... 451/56

FOREIGN PATENT DOCUMENTS

JP 2000263420 A * 9/2000

* cited by examiner

*Primary Examiner*—Timothy V. Eley
(74) *Attorney, Agent, or Firm*—Sonnenschein, Nath & Rosenthal LLP

(57) ABSTRACT

Provided are a chemical mechanical polishing apparatus and a method of chemical mechanical polishing using the same in which the clogs of the polishing fluid are prevented from being trapped between the diamond grains embedded in the dresser or removing such clogs already trapped, thereby to prevent a desired lifetime of the dresser from being shortened. Such chemical mechanical polishing apparatus is such that for polishing an object to be polished while feeding a polishing fluid between said object to be polished (semiconductor wafer) and a polishing pad, and has a turn table rotating while holding on the top surface of which a polishing pad; a pressurizing head rotating while holding on the bottom surface of which an object to be polished so as to pressure-contact the object to be polished to the polishing pad; a dresser for refreshing the top surface of the polishing pad by pressure-contacting the bottom surface of which to the polishing pad; and a dresser refreshing means (dresser cleaning unit) for refreshing the dresser during idle period thereof.

1 Claim, 8 Drawing Sheets

CHEMICAL MECHANICAL POLISHING APPARATUS AND A METHOD OF CHEMICAL MECHANICAL POLISHING USING THE SAME

BACKGROUND OF THE INVENTION

1. Field of the Invention

The present invention relates to a chemical mechanical polishing apparatus and a method of chemical mechanical polishing using the same, and in particular to those involving a dresser for refreshing the top surface of a polishing pad for polishing an object to be polished, in which the refreshment is effected by pressure-contacting such dresser under rotation to such polishing pad.

2. Description of the Related Art

Chemical Mechanical Polishing (CMP) apparatus is becoming widely used in the planarization of interlayer insulating film for isolating upper and lower wirings as multi-layered wiring structures are increasingly adopted by system LSIs (Large Scale Integrated circuits). Using the chemical mechanical polishing apparatus allows surface roughness of the interlayer insulating film to be suppressed as small as 100 nm or around.

A known chemical mechanical polishing apparatus is such that being typically shown in FIG. 7. In a chemical mechanical polishing apparatus 10, a polishing pad 14 is stretched on a turn table 12; where the polishing pad 14 being made of a material such as polyurethane foam.

Above the polishing pad 14, a pressurizing head 16 is provided so as to be rotatable and so as to be pressurized against the polishing pad 14. On the bottom surface of the pressurizing head 16, a semiconductor wafer 18 as an object to be polished is held by vacuum chucking so as to orient a plane to be polished downward.

Again above the polishing pad 14 and at a position not overlapped with that for the pressurizing head 16, a dresser 20 is provided so as to be rotatable and so as to be pressurized against the polishing pad 14. A substrate composing the upper portion of the dresser 20 is made of stainless steel (SUS), the under surface of the substrate is nickel-plated, and diamond grains (#100) are embedded in such plated surface.

A nozzle 22 is positioned above the center portion of the polishing pad 14, from which polishing fluid is dropwisely supplied to the center portion of the polishing pad 14. The polishing fluid is spread by the centrifugal force and flows into the interface between the polishing pad 14 and the semiconductor wafer 18, thereby to be used for polishing the semiconductor wafer 18.

The polishing fluid comprises a mixture (slurry) of $SiO_2$ abrasive and a 0.5 wt % KOH solution, and has a primary grain size (size of a single $SiO_2$ grain) of about 40 nm in diameter and an average grain size (size of an agglomerate composed of a couple of $SiO_2$ grains for forming siloxane bonds —Si—O—Si—) of approximately 100 nm in diameter.

Polishing of the semiconductor wafer 18 using such a chemical mechanical polishing apparatus 10 begins with making pressure-contact of the rotating pressurizing head 16 with the polishing pad 14 stretched on the rotating turn table 12, thereby to effect mutual sliding motion between the semiconductor wafer 18 and polishing pad 14 kept under contact. During the polishing of the semiconductor wafer 18, the polishing fluid is constantly dropped from the nozzle 22 and thus supplied to the interface between the polishing pad 14 and the semiconductor wafer 18.

The rotating dresser 20 is also pressure-contacted to the polishing pad 14 stretched on the rotating turn table 12, thereby to effect mutual sliding motion between the dresser 20 and polishing pad 14 kept under contact. This allows constant grinding of the surface of the polishing pad 14 by the dresser 20 so as to keep on creating a fresh surface thereof, which is also referred to as refreshing.

Typical polishing conditions relate to a number of rotation of the pressurizing head 16 of 40 rpm, a pressing force of the pressurizing head 16 against the polishing pad 14 of 58.8 $kN/m^2$, a number of rotation of the turn table 12 of 42 rpm, a number of rotation of the dresser 20 of 34 rpm, a pressing force of the dresser 20 against the polishing pad 14 of 50 $N/m^2$, an amount of polishing of interlayer insulating film of 1,000 nm, a polishing time of approx. 2 min., and a material of the interlayer insulating film of plasma TEOS (P-TEOS).

Next, parameters representing the polishing properties will be described. Such parameters representing the polishing characteristics relate to polishing uniformity (%) and polishing rate (nm/min).

According to a general method for calculating the polishing uniformity, differences in the film thickness before and after the polishing are measured for 49 points on the semiconductor wafer 18, maximum value ($D_{max}$)and minimum value ($D_{min}$) of such differences are found and then further difference between these values is obtained ($D_{max}-D_{min}$), then the value is divided by an average value ($D_{ave}$) of the differences of the film thickness before and after the polishing measured for the same 49 points multiplied by 2, and the quotient is multiplied by 100, which is expressed by the equation below:

$$\text{polishing uniformity } (\%)=(D_{max}-D_{min})\times 100/(2\times D_{ave})$$

According to a general method for calculating the polishing rate, the average value ($D_{ave}$: nm) of the differences in the film thickness before and after the polishing measured for 49 points is divided by polishing time (t: min), which is expressed by the equation below:

$$\text{polishing rate (nm/min)}=D_{ave}/t$$

Now, FIG. 5 is a graph showing a relation between operating time of the dresser 20 and cumulative operating time of the polishing pad 14 for use in the polishing of the semiconductor wafer 18. The figure shows the operating time of the dresser 20 on the abscissa and the cumulative operating time of the polishing pad 14 on the ordinate. It is apparent from the figure that the cumulative operating time of the polishing pad 14 in the polishing of the semiconductor wafer 18 sharply increases as the operating time of the dresser 20 increases.

This is probably because wear of the diamond grains embedded in the surface of the dresser 20 resulted in decrease in the amount of wear of the polishing pad 14, which prolongs the cumulative operating time of the polishing pad 14 used in the polishing of the semiconductor wafer 18. It is generally defined that the lifetime of the polishing pad 14 ends when the thickness thereof reaches a value 0.8 mm thinner than the initial thickness. Lifetime of the dresser 20 ends when the operating time reaches 300 hours.

However in the conventional chemical mechanical polishing apparatus, a problem resides in that, as shown in FIG. 8, the lifetime of the dresser 20 ends too early when the operating time reaches only as short as 100 hours or around, far from 300 hours, since clogs 26 of the polishing fluid are likely to be trapped between the diamond grains 24 on the dresser 20 and thus the polishing performance is ruined. This may result in degraded productivity with the dresser 20 since the dresser 20 needs to be frequently replaced.

Considering the foregoing problems, it is therefore an object of the present invention to provide a chemical mechanical polishing apparatus and a method using thereof, in which the dresser is prevented from being shortened in the lifetime through preventing the clogs of the polishing fluid from being trapped between the diamond grains, and through successfully removing clogs already formed.

SUMMARY OF THE INVENTION

To solve the foregoing problem, a chemical mechanical polishing apparatus of the present invention is such that used for polishing an object to be polished while feeding a polishing fluid between the object to be polished and a polishing pad, and comprises a turn table rotating while holding on a top surface of which the polishing pad; a pressurizing head rotating while holding on a bottom surface of which the object to be polished so as to pressure-contact the object to be polished to the polishing pad; a dresser for refreshing the top surface of the polishing pad by pressure-contacting the bottom surface of which to the polishing pad; and a dresser refreshing means for refreshing the dresser during idle period of the dresser.

In such chemical mechanical polishing apparatus of the present invention, the dresser refreshing means preferably refreshes the dresser by immersing the dresser in a refreshing liquid and applying ultrasonic wave to the refreshing liquid.

Again to solve the foregoing problem, a method of chemical mechanical polishing of the present invention is such that having a step for polishing an object to be polished held facedown under rotation by pressure-contacting the object to be polished to a polishing pad held on a turn table while feeding a polishing fluid between the object to be polished and the polishing pad, wherein a dresser in an operating period refreshes the polishing pad by pressure-contacting the bottom surface of the dresser under rotation to the top surface of the polishing pad, and the dresser in an idle period is refreshed while being brought apart from the polishing pad.

In such method of the present invention, the refreshment of the dresser is preferably effected by immersing the dresser in a refreshing liquid and applying ultrasonic wave to the refreshing liquid.

According to the apparatus and method of the present invention, the dresser is refreshed during its idle period while being brought apart from the polishing pad and immersed in the refreshing liquid applied with ultrasonic vibration, so that the dresser is prevented from being shortened in the lifetime through preventing the clogs of the polishing fluid from being trapped between the diamond grains, and through successfully removing clogs already formed.

DESCRIPTION OF THE PREFERRED EMBODIMENT

Specific embodiments of the present invention will be detailed hereinafter referring to the attached drawings.

FIGS. 1 to 6 are referred to explain a first embodiment of a chemical mechanical polishing apparatus and a method of chemical mechanical polishing using the same according to the present invention.

Figure 1:
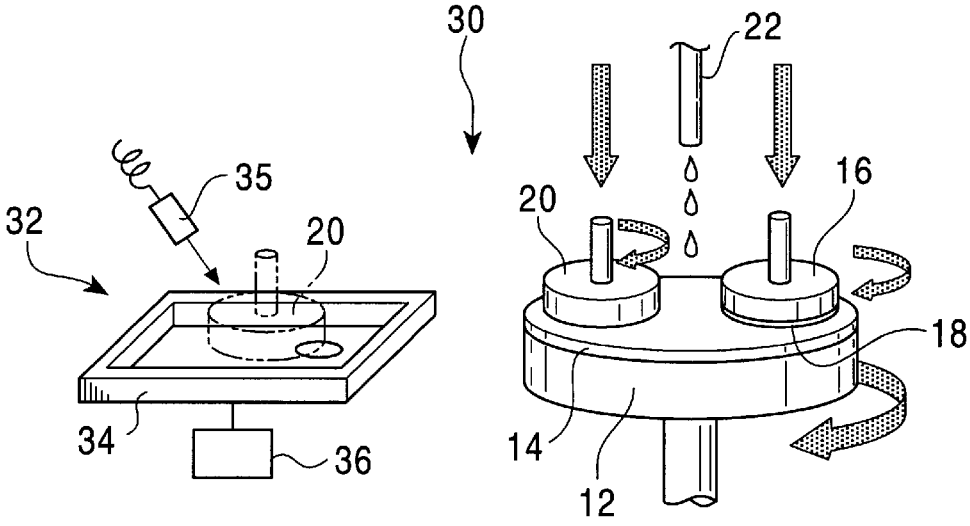
FIG. 1 is a perspective view showing an essential part of a chemical mechanical polishing apparatus 30 of a first embodiment.

FIG. 1 shows a chemical mechanical polishing apparatus 30 according to the first embodiment of the present invention. In such chemical mechanical polishing apparatus 30, a polishing pad 14 is stretched on a turn table 12; where the polishing pad 14 being made of a material such as polyurethane foam.

Above the polishing pad 14, a pressurizing head 16 is provided so as to be rotatable and so as to be pressurized against the polishing pad 14. On the bottom surface of the pressurizing head 16, a semiconductor wafer 18 as an object to be polished is held by vacuum chucking so as to orient a plane to be polished downward.

Again above the polishing pad 14 and at a position not overlapped with that for the pressurizing head 16, a dresser 20 is provided so as to be rotatable and so as to be pressurized against the polishing pad 14. A substrate composing the upper portion of the dresser 20 is made of stainless steel (SUS), the surface of the substrate is nickel-plated, and diamond grains (#100) are embedded in such plated surface. The dresser 20 is detachably held by a holding portion (not shown).

A nozzle 22 is positioned above the center portion of the polishing pad 14, from which polishing fluid is dropwisely supplied to the center portion of the polishing pad 14. The polishing fluid is spread by the centrifugal force and flows into the interface between the polishing pad 14 and the semiconductor wafer 18, thereby to be used for polishing the semiconductor wafer 18.

The polishing fluid comprises a mixture (slurry) of $SiO_2$ abrasive and a 0.5 wt % KOH solution, and has a primary grain size (size of a single $SiO_2$ grain) of about 40 nm in diameter and an average grain size (size of an agglomerate composed of a couple of $SiO_2$ grains for forming siloxane bonds —Si—O—Si—) of approximately 100 nm in diameter.

At a position aside the turn table 12 of the chemical mechanical polishing apparatus 30, an ultrasonic cleaning unit 32 (dresser refreshing means) for refreshing the dresser 20 with the aid of ultrasonic wave is provided. The ultrasonic cleaning unit 32 comprises a box-type dresser immersing portion 34 containing pure water (refreshing liquid) in which the dresser 20 detached from the holding portion located over the turn table 12 is immersed; a sensor 35 for detecting the presence of the dresser 20 in the dresser immersing portion 34; and an ultrasonic vibrator 36 connected to the dresser immersing portion 34 so as to apply ultrasonic vibration thereto.

For the ultrasonic cleaning unit 32, an ultrasonic cleaning apparatus of, for example, StandAlone Series (product name) is available. The ultrasonic cleaning apparatus has a rated output of 150 W, has an oscillation frequency of 26 kHz, and can keep the oscillation at that frequency for not less than 12 hours. For the sensor 35, a photoelectric sensor of reflection type, transmission type or the like is available.

Operation of such chemical mechanical polishing apparatus 30 will be explained referring to FIGS. 2 to 4.

Figure 2:
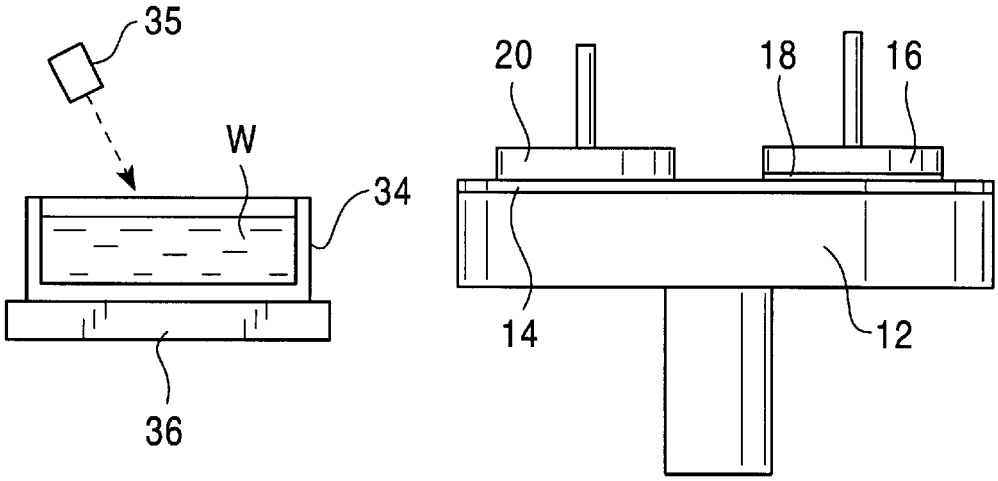
FIG. 2 is a side view showing an essential part of the chemical mechanical polishing apparatus 30 for the explanation of a motion thereof.

Operation of the chemical mechanical polishing apparatus 30 begins with turning the power switch ON (step S1 in FIG. 4), and the rotating head 16 is press-contacted to the polishing pad 14 stretched on the rotating turn table 12 as shown in FIG. 2 (step S2 in FIG. 4), thereby to make the semiconductor wafer 18 contact with the polishing pad 14 and effect the mutual sliding motion to polish the semiconductor wafer 18.

During the polishing of the semiconductor wafer 18, the polishing fluid is constantly dropped from the nozzle 22 and thus supplied to the interface between the polishing pad 14 and semiconductor wafer 18 as shown in FIG. 1.

The rotating dresser 20 is also pressure-contacted to the polishing pad 14 stretched on the rotating turn table 12 (step S2 in FIG. 4), thereby to effect mutual sliding motion between the dresser 20 and polishing pad 14 kept under contact as shown in FIG. 2. This allows constant grinding, in another word refreshing, of the surface of the polishing pad 14 by the dresser 20 so as to keep on creating a fresh surface thereof.

Typical polishing conditions relate to a number of rotation of the pressurizing head 16 of 40 rpm, a pressing force of the pressurizing head 16 against the polishing pad 14 of 58.8 $kN/m^2$, a number of rotation of the turn table 12 of 42 rpm, a number of rotation of the dresser 20 of 34 rpm, a pressing force of the dresser 20 against the polishing pad 14 of 50 $N/m^2$, an amount of polishing of interlayer insulating film of 1,000 nm, a polishing time of approx. 2 min., and a material of the interlayer insulating film of plasma TEOS (P-TEOS).

Figure 3:
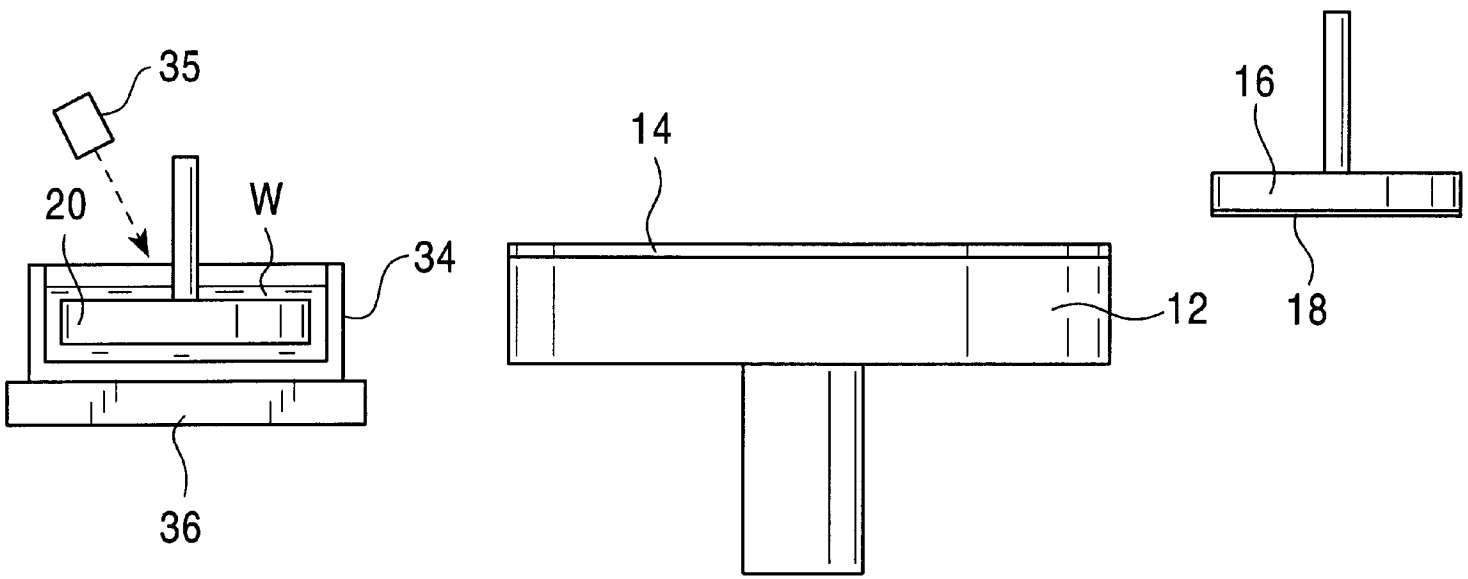
FIG. 3 is a side view showing an essential part of the chemical mechanical polishing apparatus 30 for the explanation of another motion thereof.

After such polishing operation completes (step S3 in FIG. 4), the pressurizing head 16 and the dresser 20 are set back to the respective rest positions (step S4 in FIG. 4) as shown in FIG. 3. Now the rest position for the dresser 20 is where the ultrasonic cleaning unit 32 is provided, in which the dresser 20 is immersed in pure water W constantly supplied to the dresser immersing portion 34.

Figure 4:
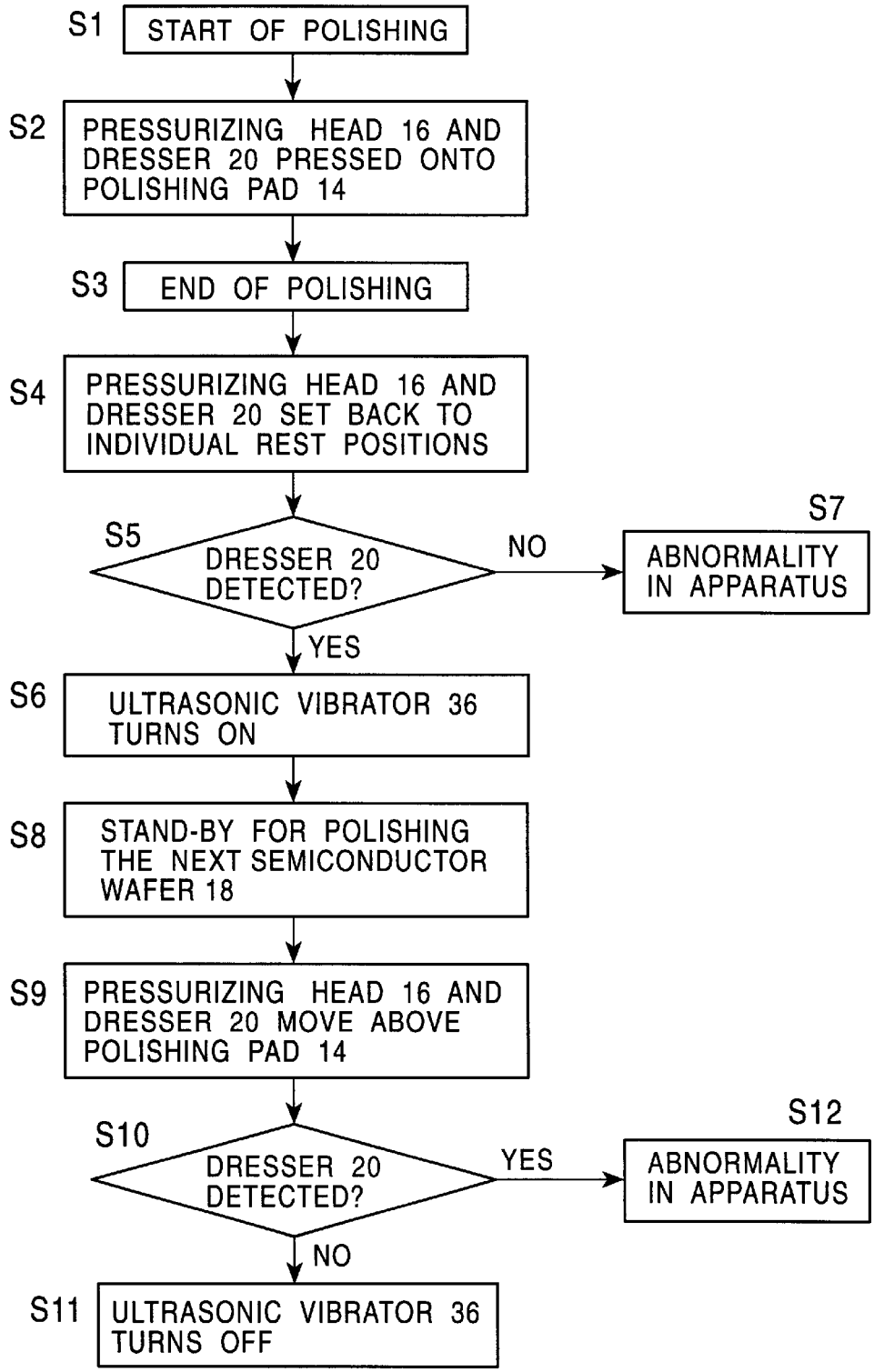
FIG. 4 is a flow chart for explaining operation procedures of the chemical mechanical polishing apparatus 30.

If a sensor 35 detects the presence of the dresser 20 in the dresser immersing portion 34 (YES for step S5 in FIG. 4), an ultrasonic vibrator 36 applies ultrasonic vibration to the dresser immersing portion 34 (step S6 in FIG. 4). Thus the dresser is prevented from being shortened in the lifetime through preventing the clogs 26 of the polishing fluid from being trapped between the diamond grains 24, and through successfully removing clogs 26 already formed.

When a sensor 35 fails in detecting the presence of the dresser 20 in the dresser immersing portion 34 (NO for step S5 in FIG. 4), abnormality (failure) of the chemical mechanical polishing apparatus 30 is identified (step S7 in FIG. 4).

Next, the chemical mechanical polishing apparatus 30 goes into a stand-by mode for the polishing of the next semiconductor wafer 18 (step S8 in FIG. 4), and the pressurizing head 16 and the dresser 20 move above the polishing pad 14 (step S9 in FIG. 4). Since the dresser 20 is now out of the dresser immersing portion 34, the sensor 35 no more detects the dresser 20 (NO for step S10 in FIG. 4), so that the ultrasonic vibrator 36 turns OFF (step S11 in FIG. 4).

If the sensor 35 detects the dresser 20 in the dresser immersing portion 34 (YES for step S10 in FIG. 4), abnormality (failure) of the chemical mechanical polishing apparatus 30 is identified (step S12 in FIG. 4).

Next, parameters representing the polishing properties will be discussed. Such parameters representing the polishing characteristics relate to polishing uniformity (%) and polishing rate (nm/min).

According to a general method for calculating the polishing uniformity, differences in the film thickness before and after the polishing are measured for 49 points on the semiconductor wafer 18, maximum value ($D_{max}$) and minimum value ($D_{min}$) of such differences are found and then further difference between these values is obtained ($D_{max}-D_{min}$), then the value is divided by an average value ($D_{ave}$) of the differences of the film thickness before and after the polishing measured for the same 49 points multiplied by 2, and the quotient is multiplied by 100, which is expressed by the equation below:

$$\text{polishing uniformity } (\%)=(D_{max}-D_{min})\times 100/(2\times D_{ave})$$

According to a general method for calculating the polishing rate, the average value ($D_{ave}$: nm) of the differences in the film thickness before and after the polishing measured for 49 points is divided by polishing time (t: min), which is expressed by the equation below:

$$\text{polishing rate (nm/min)}=D_{ave}/t$$

Figure 5:
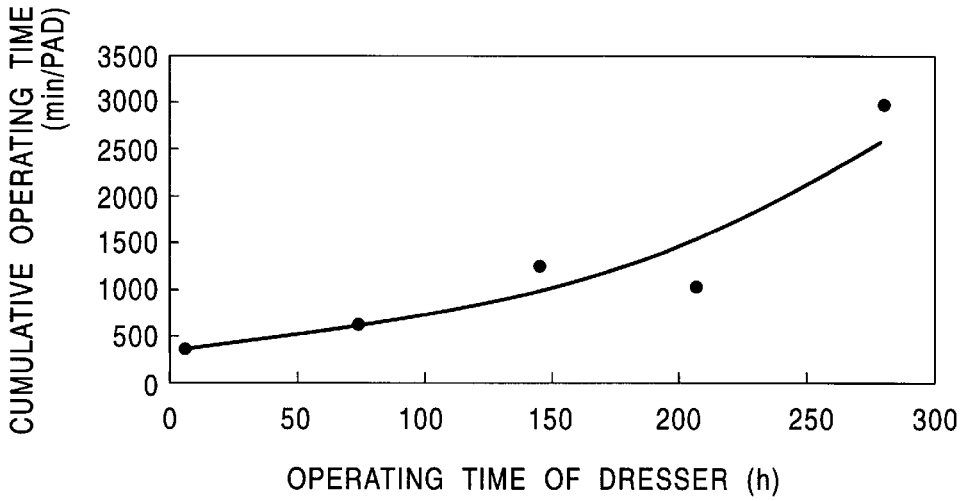
FIG. 5 is a graph showing a relation between the operating time of a dresser 20 and the cumulative operating time of a polishing pad 14.

Now, FIG. 5 is a graph showing a relation between operating time of the dresser 20 and cumulative operating time of the polishing pad 14 for use in the polishing of the semiconductor wafer 18. The figure shows the operating time of the dresser 20 on the abscissa and the cumulative operating time of the polishing pad 14 on the ordinate. It is apparent from the figure that the cumulative operating time of the polishing pad 14 in the polishing of the semiconductor wafer 18 sharply increases as the operating time of the dresser 20 increases.

This is probably because wear of the diamond grains embedded in the surface of the dresser 20 resulted in decrease in the amount of wear of the polishing pad 14, which prolongs the cumulative operating time of the polishing pad 14 used in the polishing of the semiconductor wafer 18. Lifetime of the polishing pad 14 ends when the thickness thereof reaches a value 0.8 mm thinner than the initial thickness. Lifetime of the dresser 20 ends when the operating time reaches 300 hours.

According to the chemical mechanical polishing apparatus 30 of such embodiment, the dresser 20 is prevented from being shortened in the lifetime thereof, and can be used as long as a desired lifetime of 300 hours or around. This also sharply increases the cumulative operating time of the polishing pad 14 for use in polishing the semiconductor wafer 18.

Figure 6:
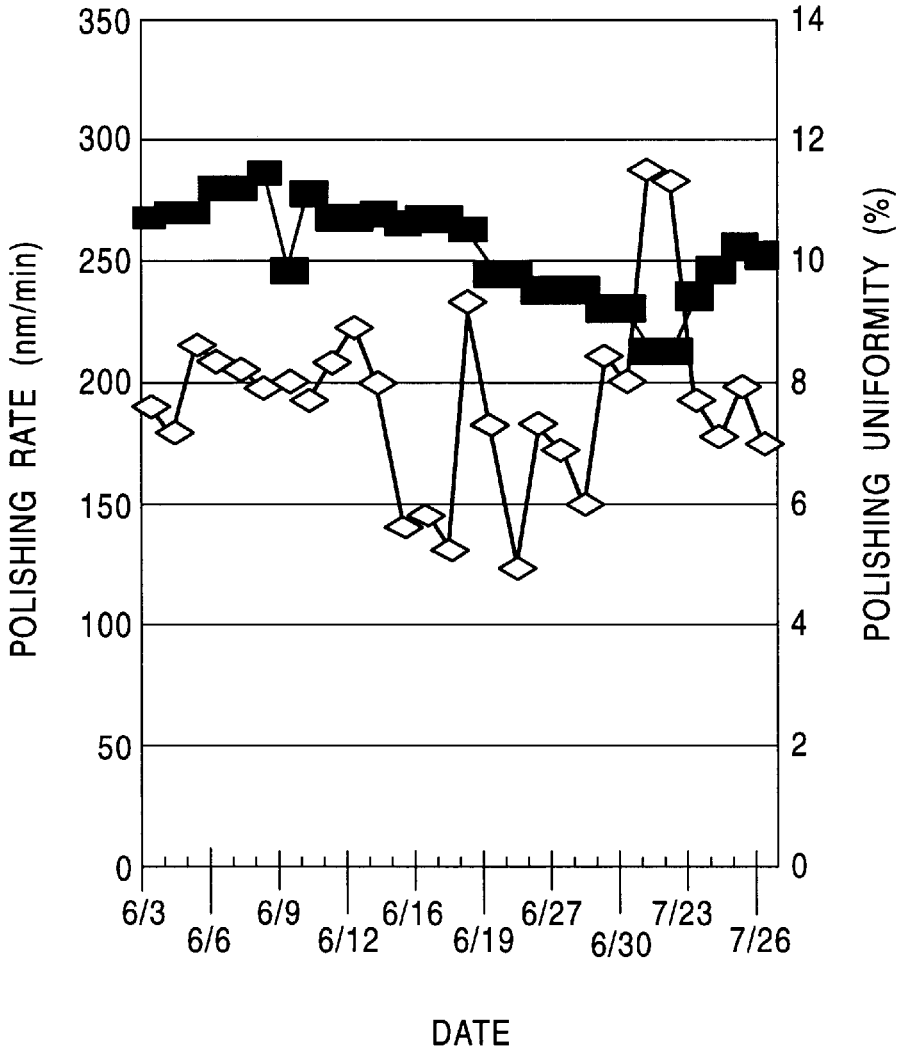
FIG. 6 is a graph showing changing trends in polishing uniformity and polishing rate in relation to ultrasonic application to the dresser 20.
Figure 7:
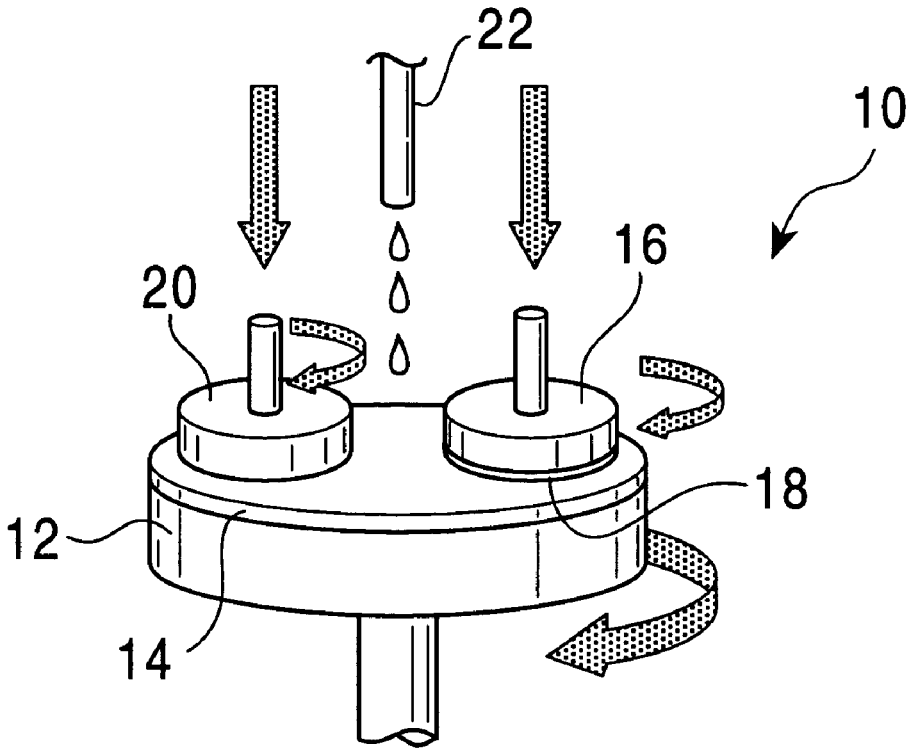
FIG. 7 PRIOR ART
FIG. 7 is a perspective view of an essential part of a conventional chemical mechanical polishing apparatus 10.
Figure 8:
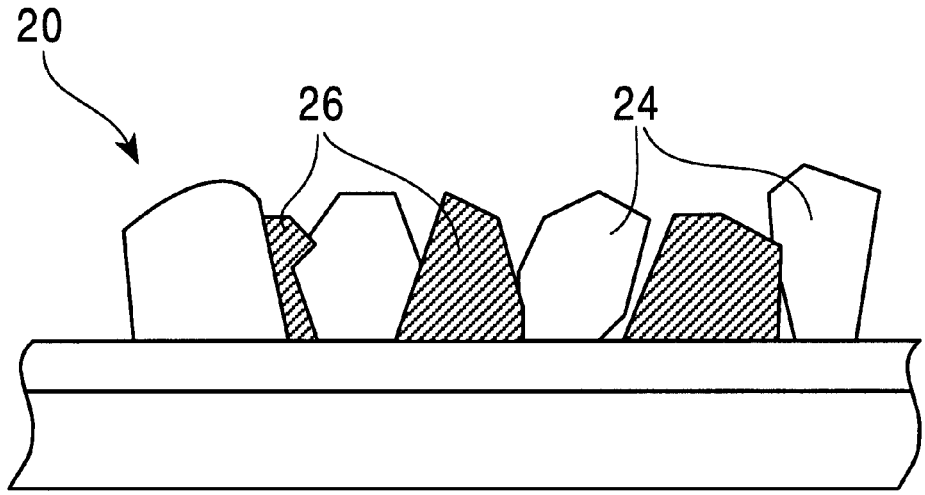
FIG. 8 is a partial enlarged view showing clogs 26 trapped between the individual diamond grains 24 embedded in the dresser 20 of the conventional chemical mechanical polishing apparatus 10.

FIG. 6 is a graph showing changing trends in the polishing uniformity and polishing rate before and after the clogs 26 of the polishing fluid trapped between the individual diamond grains 24 embedded in the dresser 20 are removed by the ultrasonic cleaning unit 32. As is clear from the figure, the ultrasonic cleaning over 12 hours on July 23 (7/23) successfully lowered the polishing uniformity indicated by open rhombic plots to approx. 7%, which had previously been raised as high as above 11%. Assuming now a polishing uniformity of 11% or larger as abnormal, the above result can be understood as an expression of great improvement.

The ultrasonic cleaning on the above date also raised the polishing rate indicated by solid square plots as high as 250 nm/min or around, which had previously been lowered as slow as 210 nm/min or around. Assuming now a polishing rate of 200 nm/min or below as abnormal, the above result can be understood as an expression of great improvement.

Thus the refreshment of the dresser 20 using the ultrasonic cleaning unit 32, in which the clogs 26 of the polishing fluid adhered to the dresser 20 are removed, can markedly improve the polishing properties (polishing uniformity and polishing rate), which allows a prolonged use of the single dresser 20 and surely prevents the lifetime thereof from being shortened. This reduces the frequency of exchanging the dresser 20 and thus improves the productivity with such dresser 20.

Since the refreshment of the polishing pad 14 by polishing using the dresser 20 can remove dust, clogs 26 or the like adhered on the polishing pad 14, so that the polished plane of the semiconductor wafer 18 can be prevented from getting scratches due to such dust, clogs 26 or the like.

While the foregoing descriptions was made for a case in which ultrasonic vibration is applied by the ultrasonic vibrator 36 to the dresser 20 in the idle period thereof, it is also allowable to supply warm water of 50° C. or above to the dresser immersing portion 34 of the dresser cleaning unit 32. Since motion of water molecules in water of 50° C. or above is more vigorous than that in cold pure water, that supplying such warm water can achieve an equivalent effect as in the application of ultrasonic vibration.

It is further allowable to supply warm water of 50° C. or above into the dresser immersing portion 34, and at the same time apply ultrasonic vibration thereto using the ultrasonic vibrator 36.

Having described specific embodiments of the present invention, it is to be understood that the present invention is by no means limited thereto and that any modification is allowable without departing from the spirit of the invention.

What is claimed is:

1. A method of chemical mechanical polishing comprising the steps of:

polishing an object to be polished held facedown under rotation by pressure-contacting said object to be polished to a polishing pad held on a turntable while feeding a polishing fluid between said object to be polished and said polishing pad;

refreshing the polishing pad in an operating period by rotating and pressure-contacting a bottom surface of a dresser to said polishing pad; and refreshing said dresser in an idling period by setting said dresser apart from said polishing pad, wherein the refreshment of the dresser is effected by immersing said dresser in a refreshing liquid and applying ultrasonic wave to said refreshing liquid.

* * * * *